US005363180A

United States Patent [19]

Shimizu et al.

[11] Patent Number: 5,363,180

[45] Date of Patent: Nov. 8, 1994

[54] FIXING DEVICE FOR ELECTROPHOTOGRAPHY AND ELECTROPHOTOGRAPHIC APPARATUS INCORPORATING THE FIXING DEVICE

[75] Inventors: Ryuuichi Shimizu, Hitachiota; Tsuneaki Kawanishi, Ibaraki; Toshiya Satoh, Hitachi; Teruaki Mitsuya; Takashi Suzuki, both of Katsuta, all of Japan

[73] Assignees: Hitachi, Ltd.; Hitachi Koki Co. Ltd., Tokyo, Japan

[21] Appl. No.: 883,363

[22] Filed: May 15, 1992

[30] Foreign Application Priority Data

May 17, 1991 [JP] Japan ..... 3-112924

[51] Int. Cl.[5] ..... G03G 15/20

[52] U.S. Cl. ..... 355/285; 355/290

[58] Field of Search ..... 355/282, 285, 289, 290, 355/295; 219/216

[56] References Cited

U.S. PATENT DOCUMENTS

| | | | |
|---|---|---|---|
| 2,297,691 | 10/1942 | Carlson | 430/55 |
| 2,618,552 | 11/1952 | Wise | 430/121 |
| 2,811,465 | 10/1957 | Greig | 430/101 |
| 2,874,063 | 2/1959 | Greig | 430/106.6 |
| 2,902,974 | 9/1959 | Greaves | 118/656 |
| 3,152,012 | 10/1964 | Schaffert | 118/656 |
| 3,909,258 | 9/1975 | Kotz | 430/122 |
| 4,580,033 | 4/1986 | Sakurai | 219/216 |
| 4,883,715 | 11/1989 | Kuge et al. | 428/421 |
| 5,123,151 | 6/1992 | Uehara et al. | 355/282 X |

FOREIGN PATENT DOCUMENTS

| | | |
|---|---|---|
| 18140 | 4/1980 | European Pat. Off. . |
| 3606662 | 2/1983 | Germany . |
| 4223910 | of 0000 | Japan . |
| 4324748 | of 0000 | Japan . |
| 60-194477 | 2/1985 | Japan . |

*Primary Examiner*—Leo P. Picard
*Assistant Examiner*—Christopher Horgan
*Attorney, Agent, or Firm*—Antonelli, Terry, Stout & Kraus

[57] ABSTRACT

Image fixing device for use in electrophotographic apparatus, capable of suppressing gloss of fixed toner image, thus stably producing images of high quality and high level of fixing intensity over a long period of time. The fixing device has a fixing roller and a pressing roller which are contacted with each other and rotate to form therebetween a nip through which a paper supporting unfixed toner image is passed to have the toner image fixed to the paper. The fixing roller has a cylindrical core having fine irregularities formed on its surface and a surface layer made of a resin. The surface of the cylindrical core has a greater elastic modulus than that of the surface layer.

18 Claims, 3 Drawing Sheets

FIXING DEVICE FOR ELECTROPHOTOGRAPHY AND ELECTROPHOTOGRAPHIC APPARATUS INCORPORATING THE FIXING DEVICE

BACKGROUND OF THE INVENTION

1. Field of the Invention

The present invention relates to a fixing device for fixing an electrophotographic monochrome toner image on an image support member such as paper and also to an electrophotographic apparatus using such a fixing device.

2. Description of the Related Art

Various electrophotographic processes and methods have been proposed in, for example, Japanese Patent Examined Publication Nos. 42-23910 and 43-24748 and U.S. Pat. No. 2,297,691. An electrophotographic process which is used most commonly has the steps of forming an electrostatic latent image on the surface of a photosensitive member made of a photoconductive material, developing the latent image into a visible image by means of a toner and transferring the developed image onto an image supporting member such as paper.

Many dry developing methods have been known for developing an electrostatic latent image by using toners, such as powder cloud method disclosed in U.S. Pat. No. 2,221,776, cascade method disclosed in U.S. Pat. No. 2,618,552, magnetic brush method disclosed in U.S. Pat. No. 2,874,063, fur brush method disclosed in U.S. Pat. No. 2,901,974, contact developing method disclosed in U.S. Pat. No. 2,811,465, pressurized developing method disclosed in U.S. Pat. No. 3,152,012, and magnetic toner developing method disclosed in U.S. Pat. No. 3,909,258. Among these known developing methods, a cascade method and a magnetic brush method are used most commonly.

Methods are also known for fixing a toner image to an image supporting member such as paper after the transfer of the toner image thereto. For example methods called a solvent fixing method, a pressure fixing method and a heat fixing method have been known. The solvent fixing method, however, has problems such as generation of offensive odor and undesirable effect on human health, due to scattering of vapor of the solvent. The pressure fixing method also is disadvantageous because of unsatisfactory fixing characteristics.

In view of the above-described shortcomings of the prior art, as well as safety and economy, a fixing device of the type called a thermal fixing device has been used, wherein the toner forming a toner image is thermally fused so as to adhere to an image supporting member such as paper. More particularly, as shown in FIG. 4 a fixing roller 1 is composed of a cylindrical core 2 made of a metal such as an aluminum alloy or ceramics and a heater 5 disposed in the cylindrical core 2, the cylindrical core 2 having a surface layer 4 made of a heat-resistant resin such as polytetra fluoroethylene or a heat-resistant elastomer material such as silicone rubber or a fluoric rubber. The fixing device further has a pressing roller 6 composed of a cylindrical core 2' made of, for example, aluminum and having a surface layer 4' made of an elastic material such as silicone rubber or a fluoric rubber or a heat-resistant resin such as fluororesin.

The fixing device further has a plurality of separation claws 18 which prevent coiling of the paper around the fixing roller or the pressing roller. For example, four to five separation claws, each having a width of several millimeters, are used. In most cases, the separation claws are provided only on the fixing roller. In case of a high-speed printing machine or a machine having double-side printing function, however, the separation claws are arranged also on the pressing roller 6.

In operation, the transfer paper 15 (image supporting member) which carries a toner image transferred thereto, passes through the nip between the fixing roller 1 and the pressing roller 6, so that the toner image is heated and pressured to be fixed on the transfer paper 15. This fixing method is generally referred to as heat roller fixing method. Although other types of thermal fixing method such as flash fixing method and oven fixing method are also known, the heat roller fixing method is used most commonly because it excels in fixing performance, fixing speed, safety and economy.

In general, an image exhibits gloss after it is fixed by a conventional fixing device having a fixing roller with a heat-resistant resin surface layer 4. In particular, monochromatic image after such fixing is not easily visible because of reflection of light. This heat roller fixing method employing this type of fixing roller could not provide fixed image of high quality. In general, the fixing roller having a surface layer made of a fluororesin is produced by heating the fluororesin to melt it and applying the melt on the surface of the cylindrical core 2, followed by polishing of the coating surface layer by buffing. Consequently, the surface of the layer 4 is highly smooth and has only a small degree of elasticity. Consequently, the toner particles forming the toner image on the image supporting member 15 are squeezed into flat state, so that the fixed image becomes glossy.

The above-mentioned problem due to gloss of the fixed image is not so serious when the surface layer 4 of the fixing roller is made of an elastic material such as a silicone rubber. Namely, in such a case, partly because fine irregularities are formed on the surface of the layer 4 and partly because the surface layer has appreciable elasticity, the toner particles are not squeezed, so that the image after the fixing does not have any gloss.

The elastic material such as silicone rubber, however, generally exhibits small resistance to wear, so that the surface layer 4 of the fixing roller tends to be worn down rapidly due to frictional contact with the image supporting member 15, separation claws 18 and a temperature sensor 19, so that the fixing performance is impaired in a short period of time, resulting in a short life of the fixing roller.

The elastic surface layer is generally not resistant to mechanical compression so that the surface layer is made to have a large thickness in order to attain a sufficient resistance to compression. Such a large thickness of the surface layer reduces transfer of heat from the heater 5 to the surface of the surface layer, i.e., the surface of the fixing roller 1. Consequently, the temperature of the surface of the fixing roller 1 is undesirably lowered to a level below that required for the fixing, particularly when a number of consecutive image supporting members are made to pass through the fixing device, with the result that the fixing performance is seriously deteriorated. Consequently, the elastic member tends to swell and deform due to presence of a parting agent such as silicone oil which is applied to prevent toner offset, causing wrinkling of the image supporting member 15 such as a paper. The use of such a parting agent is necessary because omission of such agent undesirably not only allows occurrence of toner offset but tends to cause part of the toner on the image supporting member 15 to adhere to the surface layer 4 of the fixing roller 1 so as to impede separation of the image supporting member from the fixing roller 1. With this type of fixing roller, therefore, it is difficult to obtain a maintenance-free type fixing device.

Japanese Patent Unexamined Publication No. 61-32081 discloses a method which employs a specific fixing roller constructed to suppress generation of gloss of fixing images. This fixing roller has a cylindrical core 2 clad with a fluorine-type thermally contracted tube through the intermediary of an adhesive layer. The surface of the tube has been coarsened to a surface roughness of 2 to 3 μm Rz in terms of ten-point average measurement. Fixing rollers, however, are required to have a service life of a period which is 2 to 3 times as long as that of developing agent. Since the coarsened surface of the fixing roller of this type are rapidly worn, this type of roller cannot be satisfactorily used as a fixing roller which is required to provide a number of copies, e.g., several thousands and, in some cases, more than one million. A high-speed fixing essentially requires that the speed of rotation of the fixing roller be increased. Unfortunately, however, the coarsened surface promotes toner offset particularly when the fixing roller is rotated at high speed.

In the field of electrophotography, there have been increasing demands for higher operational speed and improved image quality, as well as for reduction in the power consumption and production cost. In particular, extension of the life of fixing roller and elimination of necessity for maintenance work for fixing roller are matters of great concern.

SUMMARY OF THE INVENTION

Accordingly, an object of the present invention is to provide a fixing roller for use in electrophotography, which can operate over a long period of time and which can provide high level of fixing intensity of the fixed image, while reducing gloss of fixed image particularly when the image is a monochromatic image.

Another object of the present invention is to provide a fixing device of a printer for use in, for example, with electrophotographic apparatus, the fixing device incorporating the above-described fixing roller.

Still another object of the present invention is to provide an electrophotographic apparatus which can provide electrophotographic monochromatic image with reduced gloss and which has a wide toner non-offset band. intensive studies have been conducted with a view toward developing a fixing roller which has an extended life and which can fix monochromatic image without gloss. More specifically, the relationships between the configuration of the surface layer of the fixing roller and the gloss of the fixed image, between the surface layer and underlying layers, and between the surface layer and the viscoelasticity of the toner used were examined.

As a result of the studies, it has been found that the quality of the fixed image is largely influenced by the construction, properties and elastic modulus of the surface layer of the fixing roller or of underlying layers underlying the surface layer.

The greater the degree of flatness of the fixed image, the greater the gloss of the fixed image and, hence, the greater the light reflection, resulting in inferior visibility of the image. It is therefore effective to form fine irregularities on the fixed image surface since such irregularities scatter light to reduce light reflection. In case of color images, however, images with gloss are often preferred because reflected light makes colors more noticeable. High degree of smoothness of a film having thereon a fixed image is also important in the case of an overhead projector because in such a use diffused reflection of the transmitted light on the film will degrade the quality of the projected image.

In the case of monochromatic images, in particular white and black images, to which the present invention pertains, the gloss of the fixed image is reduced as much as possible, preferably 10% or less in terms of gloss degree which will be explained later, because the quality of the image is seriously impaired by the reflection of the light.

In a first aspect of the present invention, there is provided a fixing device for use in an electrophotographic apparatus, comprising a pair of pressing means opposing each other to form therebetween a nip through which an image supporting member supporting an unfixed toner image is passed so that the toner image is fixed to the image supporting member, wherein one of the pressing means which contacts the toner image on the image supporting member has a layer formed of a soft matrix and granular particles dispersed in the matrix and having greater hardness than the matrix, whereby fine irregularities are formed on toner surfaces on the image supporting member by the granular particles under application of pressure during fixing.

In a second aspect of the invention, one of the pressing means which contacts the toner image on the image supporting member may have an underlying layer and a surface layer overlying the underlying layer, with the underlying layer having a greater modulus of compressive elasticity than that of the surface layer so that the surface layer is deformed by the underlying layer under application of pressure during fixing, whereby fine irregularities are formed on toner surfaces on the image supporting member.

In a third aspect of the invention, the underlying layer may be formed of a soft matrix and granular particles dispersed in the matrix and having a greater hardness than that of the matrix, the hard granular particles having a greater modulus of compressive elasticity than that of the surface layer.

In another aspect of the invention an electrophotographic apparatus is provided comprising a photosensitive drum having a photoconductive layer formed thereon; charging means for providing the surface of the photosensitive drum with a predetermined electric charge; light irradiation means for applying light to the surface of the photosensitive drum in accordance with image information, so that electric charges are locally removed from the surface of the photosensitive drum thereby forming an electrostatic latent image; developing means for developing the electrostatic latent image into visible toner image by means of a toner; transfer means for transferring the toner image to an image supporting member; fixing means for fixing the transferred toner image onto the image supporting member; charge removing means for removing residual electric charges remaining on the surface of the photosensitive drum after the transfer; and cleaning means for removing any residual toner from the surface of the photosensitive drum after the transfer; wherein the fixing means includes a fixing roller and a pressing roller which are adapted to rotate while contacting with each other, the fixing roller including a cylindrical core and a surface layer of a uniform thickness on the surface of the cylindrical core, the surface of the core having a greater modulus of compressive elasticity than that of the surface layer so that, under application of fixing pressure, the cylindrical core deforms the surface layer so as to form fine irregularities on toner surfaces on the image supporting member.

In the first aspect, the pressing means such as a fixing roller has a layer formed thereon, which is composed of a soft matrix and granules being harder than the matrix and dispersed therein. Such a layer can be obtained by, for example, dispersing filler particles in a soft resin matrix, the filler particles being of particle size corresponding to the roughness of the fine irregularities to be formed. It is also possible to use, as the material for the surface layer of the pressing member, a thermosetting resin-mixed polyimide containing fluororesin, which, after setting, leaves hard polyimide dispersed in soft fluororesin.

In operation, the soft matrix portion is elastically deformed by the pressure applied during fixing, so that hard filler particles form fine irregularities on the surface of the image supporting member such as paper which carries a toner image, so that the image after the fixing scatters light.

In the second aspect, difference in modulus of compressive elasticity between the surface layer which forms the surface of pressing means such as a fixing roller and an underlying layer underlying the surface layer is used to provide the surface of the underlying layer with a roughened surface. Since the underlying layer has a greater modulus of compressive elasticity than that of the surface layer, application of the fixing pressure serves to force and deform the surface layer upward to form fine irregularities on surface of the surface layer, which irregularities serves to coarsen the surface of the image carrying member, whereby the gloss of the fixed image is reduced. In this aspect of the invention, fine irregularities can be formed with high degree of reproducibility even when the surface layer has been worn down, i.e., as long as the surface layer remains, since such roughness is given by the underlying layer under the surface layer.

In the third aspect, the underlying layer in the second aspect described above has the surface layer in the first aspect of the invention formed thereon. The same advantage as that offered by the second aspect can be obtained by the use of filler particles having a greater modulus of compressive elasticity than that of the surface layer.

When the pressing means such as a fixing roller is of the type in which the surface layer is directly formed on the cylindrical core, the object of the present invention can be achieved by forming the aforementioned irregularities on the surface of the core. In such a case, the irregularities provide a granular-shaped irregular surface of comparatively uniform size formed by sand blasting or etching. When the cylindrical core is formed from aluminum by cold drawing, an irregular surface comprising line impressions which extend in the direction of the drawings can not achieve the object of the present invention.

The fine irregularities may be formed on the surface of an underlying layer which is formed from, for example, a resin on the surface of the cylindrical core. In such a case, however, it is essential that the underlying layer has a greater modulus of compressive elasticity than that of the surface layer. Otherwise any irregularities could not be formed on the surface of the surface layer even when fixing pressure is exerted.

The irregular structure of the underlying layer may be formed by a suitable roughening method such as sand blasting or may be formed by dispersing metallic or other inorganic fillers or organic fillers in the matrix of the underlying layer material. The object of the present invention can be achieved by using a filler having a greater modulus of compressive elasticity than that of the surface layer.

Similarly to the dispersion of the abovementioned organic filler after curing or setting of the underlying layer, the object of the present invention also can be achieved by forming granular particles in the underlying layer, which granular particles have a greater modulus of compressive elasticity than that of the surface layer. Such granular particles can be formed of, for example, thermosetting polyimide containing fluororesin. When this type of material is thermally set, polyimide having a comparatively large modulus of compressive elasticity appears in the form of minute islands which are dispersed in a random manner in the fluororesin matrix having a comparatively small modulus of compressive elasticity, whereby an underlying layer is obtained which is materially equivalent to that formed by dispersing particles of polyimide. A similar effect is obtained by using a porous material as the material of the underlying layer.

Preferably, the underlying layer also functions as an adhesive through which the surface layer is bonded to the cylindrical core.

It is also preferred that the difference in modulus of compressive elasticity between the underlying layer and the surface layer is 2000 kg/cm$^2$ or greater. The surface roughness of the fine irregularities ranges between 5 and 50 $\mu$m and preferably between 10 and 45 $\mu$m, when measured by ten-point averaging method. The surface roughness of less than 5 $\mu$m cannot produce the expected effect. Conversely, surface roughness exceeding 50 $\mu$m may cause the surface layer to be damaged to shorten the life of the fixing roller particularly when the underlying layer and the surface layer are respectively made of a metal and an organic material, since metals generally have a substantially greater modulus of compressive elasticity than those of organic materials. Conversely, when the underlying layer is of a resin layer, conduction of heat is reduced to an unacceptably low level if the underlying layer has a thickness greater than 50 $\mu$m, so that the fixing speed or fixing intensity of the fixed image is undesirably lowered.

Metals such as aluminum alloys, ceramics and heat-resistant plastics can suitably be used as materials for the cylindrical core of the fixing roller.

It is possible to use, as the material of the surface layer of the fixing roller, a heat-resistant fluororesin such as ethylene tetrafluoride or a fluorine type heat contracting resin such as tetrafluoroethylene-perfluoroalkylvinylether copolymer (PFA). Preferably, the surface layer made from these materials has a thickness of 20 to 100 m, in order to obtain required heat conductivity and mechanical properties, as well as wear resistance.

As the material of the underlying layer, it is possible to use a fluorocarbon polymer such as polyimide, fluoric polyimide and tetrafluoroethylene, as well as a mixture of heat-resistant resins such as polyimide and fluororesin.

The pressing roller serves for backing up the fixing roller during fixing and is provided with an elastic surface layer which is formed from silicone rubber, fluoric rubber or fluorosilicone rubber formed to provide a required nip width. This surface layer may be coated with a fluoric heat contracting resin layer as required.

The fixing roller or the pressing roller may be heated by conventional heating means such as a sheath heater which is disposed inside each roller.

The surface of the fixing roller and/or the pressing roller may be provided with a thin film of an organic siloxane such as silicone oil for reducing the surface energy, thereby improving separation of the image supporting member such as paper from the roller.

The fixing device of the present invention is typically explained with reference to roller type one shown in FIG. 4 but the present invention can also be applied to a belt-type fixing device schematically shown in FIG. 5.

The surface state of the fixed image also is influenced by visco-elastic characteristic of the toner used for development. More specifically, the gloss of the fixed image increases as the ratio between the loss elastic modulus indicative of viscosity and storage elastic modulus indicative of elasticity (loss stangent=loss elastic modulus/storage elastic modulus) increases. Namely, when the toner particles are pressed and squeezed under pressure with or without heat, these particles conform to the state of the surface of the fixing roller when the rebounding or elastic force for recovering original shape of each particle is exceeded by the force produced by viscosity. The above-mentioned ratio, therefore, is preferably small.

The storage elastic modulus also affects toner offset on the fixing roller during fixing. A too small storage elastic modulus undesirably reduces non-offset band (temperature range over which offset does not occur). Conversely, a too large storage elastic modulus affects the fixing intensity and undesirably enhances viscosity (Viscosity is preferably as small as possible.).

Based upon the above-described concepts, the value of the loss tangent (tan $\delta$) is preferably 4 or less. When the value of the loss tangent exceeds 4, the gloss of the fixed image exceeds 10% in case of a 135 kg ream weight paper. Such a high level of gloss is not preferred for monochromatic image. The storage elastic modulus is preferably $2\times20^2$ Pa or greater, and, preferably, between $2\times10^2$ and $1\times10^4$ Pa. The non-offset band tends to become narrower when the storage elastic modulus is less than $2\times10^2$ Pa.

The fixing device in accordance with the present invention can effectively fix toner images when the toner is a powder mainly composed of one, two or more of the following materials with addition of a pigment of required color. These toner materials comprise: styrene-type resins (polymer or copolymer containing styrene or styrene substituent) such as polystyrene, chloropolystyrene, poly-$\alpha$-methylstyrene, styrene-chlorostyrene copolymer, styrene-propylene copolymer, styrene-butadiene copolymer, styrene-vinylchloride copolymer, styrene-vinylacetate copolymer, styrene maleic acid copolymer, styrene-esteracrylate copolymer (e.g., styrene-methylacrylate copolymer, styrene butylacrylate copolymer, styrene-octylacrylate copolymer and styrene-phenylacrylate copolymer), styrene-ester methacrylate copolymer (e.g., styrene-methylmethaacrylate copolymer, styrene butylmethaacrylatecopolymer, styrene-octylmethaacrylate copolymer and styrene-phenylmethaacrylate copolymer), styrene-$\alpha$-methyl chloroacrylate copolymer, styrene-acrylonitrile-ester acrylate copolymer; vinyl chloride resin; rosin-denaturated maleate resin; phenol resin; epoxy resin; ester resin; low-molecular polyethylene; low-molecular polypropylene, ionomer resin, urethane resin; ketone resin; styrene-ethylacrylate resin; xylene resin and polyvinyl butyral.

The fixing device of the present invention can fix toner images such that the images after fixing exhibit reduced gloss, by virtue of the fact that the coarse surface, i.e., fine irregulars, formed by the roller surface layer during fixing, serves to scatter and diffuse light.

In one form of the present invention, fine irregularities are formed on the underlying layer having a greater modulus of compressive elasticity than that of the surface layer. When fixing pressure is exerted, the fine irregularities cause the surface layer to be deformed towards outer side such that similar fine irregularities appear on the surface layer. The pattern of such fine irregularities is then transferred to the fixed image surface. This type of fixing roller can withstand a long use regardless of the wear of the surface layer, since the fine irregularities formed on the underlying layer function independently of reduction in the thickness of the surface layer due to wear.

DESCRIPTION OF THE PREFERRED EMBODIMENTS

Figure 1:
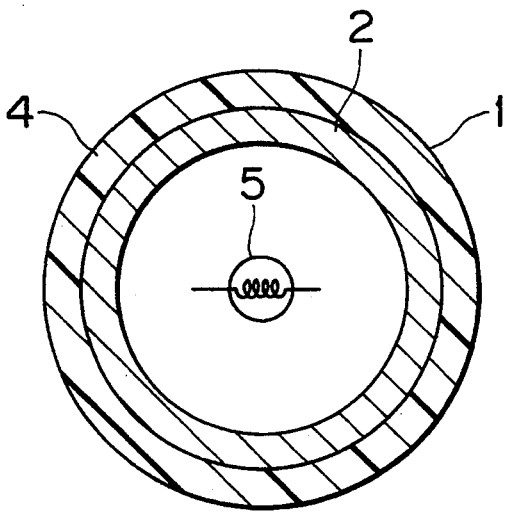
FIG. 1 is a schematic sectional view of a fixing roller incorporated in an embodiment of a fixing device in accordance with the present invention.
Figure 2:
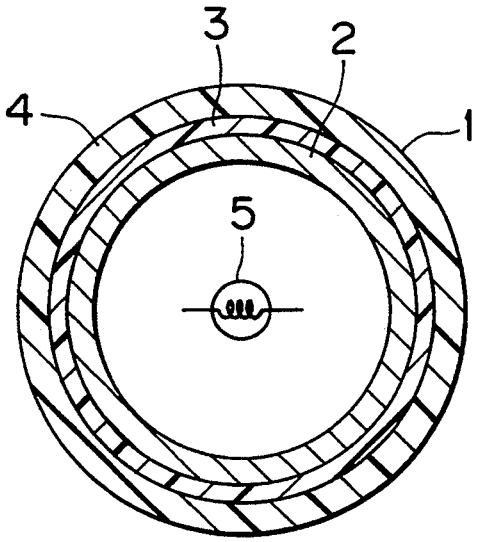
FIG. 2 is a schematic sectional view of a fixing roller according to another embodiment of the present invention.

Referring now to the drawings and, more particularly, to FIG. 1 a fixing roller 2 of the fixing device in accordance with the present invention has a cylindrical core 2 made of an aluminum alloy and a surface layer 4 made of a resin and formed on the surface of the cylindrical core 2. FIG. 2 shows another type of fixing roller wherein an underlying layer 3 of a resin is formed on the cylindrical core 2 and a surface layer 4 of a resin is formed on the underlying layer 3. This fixing roller is intended for fixing a toner image by heat which is generated by a heater 5 disposed in the cylindrical core 2.

Figure 3:
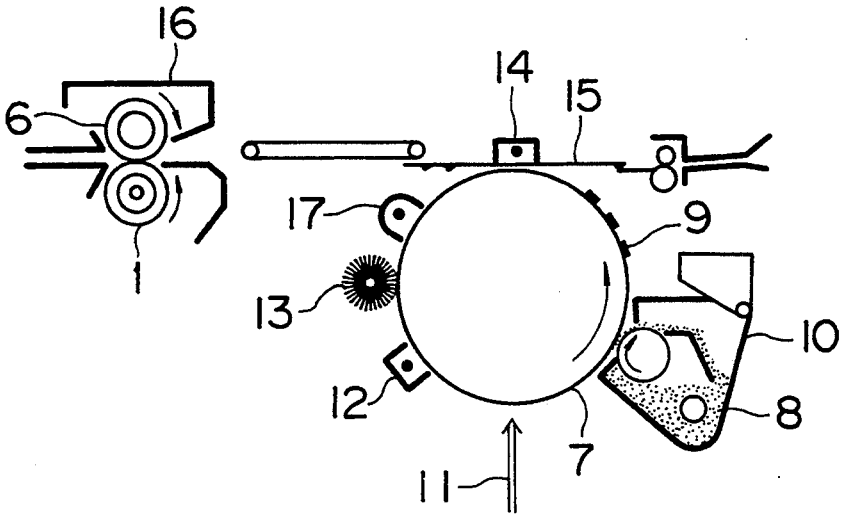
FIG. 3 is a schematic illustration of an electrophotographic apparatus used for the purpose of evaluation of the effect of the invention.
Figure 4:
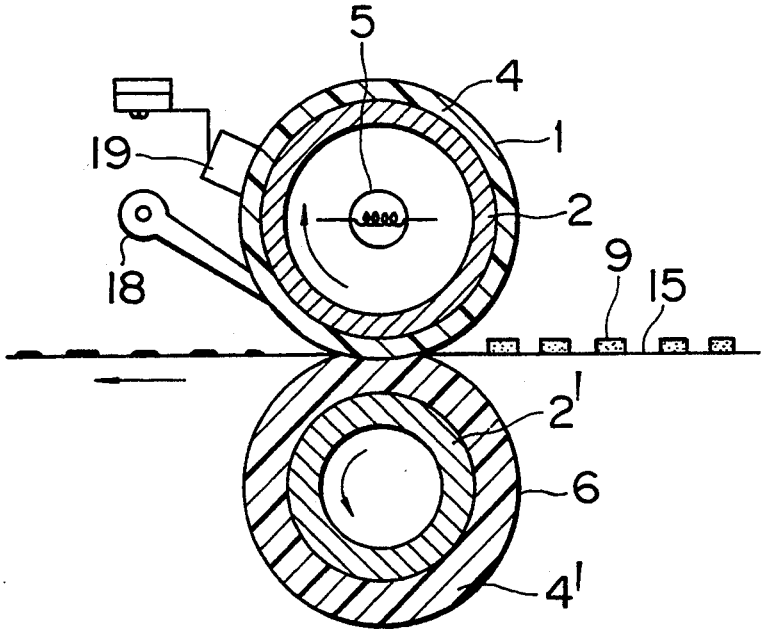
FIG. 4 is a schematic illustration of a fixing device used in an electrophotographic apparatus.

As shown in FIG. 3, an electrophotographic apparatus has a photosensitive drum 7 having an organic photoconductive layer formed thereon and adapted to rotate in the direction of the arrow. In operation, the surface of the photosensitive drum 7 is given predetermined electric charges by a charger 12. The surface of the photosensitive drum 7 thus charged is scanned by a laser beam 11 modulated in accordance with image information so that the charges are removed from the portions irradiated with the scanning laser beam, whereby an electrostatic latent image is formed on the surface of the photosensitive drum 7. Subsequently, the electrostatic latent image is developed by a toner 9 which has been frictionally electrified in a developer agent 8 contained in a developing unit 10, whereby a visible toner image is formed on the surface of the photosensitive drum 7. This visible toner image is then transferred to a recording paper (image support member) 15 by a transfer device 14, and the transferred toner image is then fixed by the fixing device 16 of the present invention.

Electric charges remaining on the surface of the photosensitive drum 7 after the image transfer are removed by a charge removing device 17 and any residual toner particles are removed by a fur brush 13 which serves as cleaning means. The surface of the photosensitive drum 7 is then charged again by the charger 12. This operation is repeated for subsequent copying.

The fixing device 16 has a pressing roller 6 which is composed of a cylindrical core, a heat-resistant elastic layer of 7 mm thick formed on the surface of the cylindrical core from HTV (High Temperature Vulcanization) silicone rubber, and a heat-contracting tube of 40 μm thick formed on the surface of the heat-resistant elastic layer from PFA (ethylene tetrafluoride-perfluoroalkyl vinylether copolymer). The pressing roller 6 has an outside diameter of 60 mm and is mounted for rotation in the direction of the arrow in accordance with the rotation of the fixing roller 1. Although not shown, a pressing means is provided for developing a predetermined level of pressure between the fixing roller 1 and the pressing roller 6.

EXAMPLE 1

A cylindrical core 2 formed by, for example, drawing from an aluminum alloy (modulus of compressive elasticity: $7\times10^5$ kg/cm$^2$) was polished at its surface to remove line impressions which were formed during the drawing. Subsequently, the surface of the cylindrical core was subjected to blasting to be coarsened, i.e., to form fine irregularities, to a degree of 20 μm in terms of ten-point averaging measurement method. Then, a heat-contracting tube of PFA was fitted on the coarsened surface of the cylindrical core and was heated so that a film of 40 μm (modulus of compressive elasticity: 6,700 kg/cm$^2$) was formed on the cylindrical core, whereby a fixing roller of 60 mm in outside diameter and having a smooth surface was obtained. A heater 5 was installed in the cylindrical core as shown in FIG. 1.

Meanwhile, a compound having the following compositions was preliminarily mixed by a Henschel mixer:

| | |
|---|---|
| styrene-butylacrylate copolymer | 100 weight parts |
| chromium salicylate complex compound | 2 weight parts |
| carbon black (carbon No. 44) | 10 weight parts |
| polypropylene | 5 weight parts |

The mixture was melted and kneaded by a twinshaft extruder and was pulverized by a jet mill, followed by a classification by a zig-zag type classifier into toner particles of a mean particle size of 11 μm. A bicomponent developing agent was then prepared by mixing this toner with a ferrite carrier (F-150: produced by Powder Tec Company) at a toner to carrier weight ratio of 3:97. Using an inversion developing type laser printer, images were formed with the thus obtained developing agent on consecutive 60 copy papers (size A-4) and the images on these papers were continuously fixed by a fixing device having the aforementioned fixing roller and pressing roller. The surface temperature of the fixing roller was set to 190° C.

The image fixed by the above-described process showed a gloss degree of 7% in 1-inch square black solid portion and image intensity of 90% or higher. The gloss degree and the image intensity were not substantially changed even after continuous copying and fixing test of 500,000 sheets of paper.

In the above test, the gloss degree was measured by forming and fixing a 1-inch square solid black image onto a paper of 135 kg ream weight (about 42 pounds ream weight) and measuring the gloss degree Gs (75°) using a variable-angle gloss meter [VG-1B: produced by Nippon Densyoku). The image intensity was measured by applying a scotch mending tape (No. 810: produced by 3M Company) to the above-mentioned 1-inchsquare solid black image, pressing the tape at a pressure of 2 kg by means of a metallic roll of 60 mm dia., peeling the tape off the paper and then comparing the image density after the peeling with the image density measured before applying the tape.

EXAMPLES 2 to 9 AND COMPARATIVE EXAMPLES 1 TO 7

A thermosetting polyimide (modulus of compressive elasticity: 23,000 kg/cm$^2$) was applied to the surface of the cylindrical core 2 made of the aforesaid aluminum alloy, and was then thermally set. The surface of the polyimide layer was then subjected to blasting so that the surface of this layer was coarsened to a ten-point mean surface roughness of 20 μm, whereby an underlying layer was formed. A heat-contracting tube of PFA covered the underlying layer and was heated so that a film of 40 μm thick (modulus of compressive elasticity 6,700 kg/cm$^2$) was formed. Then, a heater 5 was disposed in the cylindrical core 2, whereby a fixing roller of the types shown in FIG. 2, having an outside diameter of 60 mm, was obtained.

Fixing rollers of Examples 3 onwards also were prepared by forming underlying layers and surface layers by the same process as above using resin layer materials shown in Table 1. The thus prepared fixing rollers were incorporated in a fixing device and was subjected to the same continuous printing and fixing test as in Example 1, for measurement of the degrees of gloss and image intensity. The results of measurement also are shown in Table 1.

In each of Examples 6, 7 and 8 and Comparative Example 7, the underlying layer was not subjected to blasting so that the surface of fixing roller was smooth. In this state, it was impossible to measure the roughness or size of the polyimide particles embedded on the underlying layer. Therefore, after formation of the surface layer, a portion of the surface layer was peeled off from the underlying layer to expose the surface of the underlying layer, and the roughness of the exposed surface was measured by ten-point measurement method. As a result of the peeling, the fluororesin portion was deposited to the PFA of the surface layer so as to leave the granular polyimide on the underlying layer. The sizes of the polyimide grains thus remaining on the underlying surface were measured.

TABLE 1

| Examples and Comparative Examples | | Materials of layers | Modulus of compressive elasticity (kg/cm$^3$) | Surface roughness (μm) | Film thickness (μm) | Image gross (%) | Fixing intensity (%) | Image state |
|---|---|---|---|---|---|---|---|---|
| Example | | | | | | | | |
| 1 | Surface layer | PFA tube | 6700 | — | 40 | 8.1 | 95 | Stable over 500,000 sheets of copying paper or more |
| | Underlying layer | Thermosetting polyimide | 23000 | 20 | 50 | | | |
| 2 | Surface layer | PFA tube | 6700 | — | 40 | 7.0 | 98 | Good |
| | Underlying layer | Aluminum | $7 \times 10^5$ | 20 | — | | | |
| 3 | Surface layer | PFA tube | 6700 | — | 40 | 8.8 | 92 | Good |
| | Underlying layer | Fluorine type thermosetting polyimide resin | 10600 | 28 | 70 | | | |
| 4 | Surface layer | Ethylene tetrafluoride resin | 5500 | — | 50 | 9.0 | 93 | Good |
| | Underlying layer | Thermosetting polyimide | 23000 | 15 | 50 | | | |
| 5 | Surface layer | PFA tube | 6700 | — | 30 | 7.9 | 90 | Stable over 300,000 sheets of copying paper or more |
| | Underlying layer | Thermosetting epoxy resin | 23000 | 48 | 60 | | | |
| 6 | Surface layer | PFA tube | 6700 | — | 40 | 8.7 | 94 | Stable over 1,000,000 sheets of copying paper or more |
| | Underlying layer | Thermosetting polyimide resin containing fluoro-resin | 16200 | 21 | 25 | | | |
| 7 | Surface layer | PFA tube | 6700 | — | 40 | 9.1 | 91 | Good |
| | Underlying layer | Thermosetting polyimide resin containing fluororesin | 10600 | 11 | 35 | | | |
| 8 | Surface layer | PFA tube | 6700 | — | 20 | 10.0 | 95 | Good |
| | Underlying layer | Thermosetting polyimide resin containing fluororesin | 9000 | 40 | 50 | | | |
| 9 | Surface layer | PFA tube | 6700 | — | 25 | 12.0 | 94 | Good |
| | Underlying layer | Thermoseting polyimide | 23000 | 6 | 40 | | | |
| Comparative Example | | | | | | | | |
| 1 | Surface layer | PFA tube | 6700 | — | 40 | 20.0 | 92 | High level of gloss |
| | Underlying layer | Thermosetting polyimide | 23000 | 3 | 50 | | | |
| 2 | Surface layer | PFA tube | 6700 | — | 40 | 6.0 | 98 | Surface crack after reproduction of 100,000 sheets of copying paper |
| | Underlying layer | Aluminum | $7 \times 10^5$ | 60 | — | | | |
| 3 | Surface layer | PFA tube | 6700 | — | 40 | 34.0 | 97 | High level of gloss. |
| | Underlying layer | PFA tube | 6700 | 30 | 40 | | | |
| 4 | Surface layer | PFA tube | 6700 | — | 40 | 35.0 | 95 | High level of gloss. |
| | Underlying layer | Ethylene tetrafluoride resin | 5500 | 25 | 50 | | | |
| 5 | Surface layer | RTV silicone rubber | — | — | $5 \times 10^3$ | 7.0 | Initial | Fixing intensity reduced |
| | Underlying layer | Thermosetting polyimide | 23000 | 40 | 50 | | 95 | to 30% after continuous fixing |
| 6 | Surface layer | RTV silicone rubber | — | — | 1000 | 7.0 | 95 | Life of roll expired after |
| | Underlying layer | Thermosetting polyimide | 23000 | 40 | 50 | | | reproduction of 20,000 sheets of copying paper |
| 7 | Surface layer | PFA tube | 6700 | — | 40 | 27.5 | 94 | High level of gloss |
| | Underlying layer | Fluorine type thermosetting polyimide resin | 16200 | 2 | 25 | | | |

Thermosetting added.
"Fluorine-type polyimide resin" changed to --Thermosetting polyimide resin containing fluororesin--

Images were developed by using a black toner containing styrene-acrylic resin having storage elastic modulus (G') of 1680 Pa and loss tangent (tan δ) of 1.6 at 150° C. Using the fixing roller of Example 6, continuous printing and fixing test was conducted under the same conditions as in Example 1. In this case, the fixing device exhibited superior performance: namely, image gloss of 7.0%, fixing intensity of 97%, cold offset generation temperature of 165° C. or less (180 kg (approx. 56 pounds) ream weight paper) and hot offset generation temperature of 230° C. or higher (55 kg (approx. 17 pounds) ream weight paper), thus proving a wide non-offset band. The gloss degree, fixing intensity and non-offset band width were little changed even after consecutive 500,000 continuous printing and fixing cycles. Clear and stable copy image could be obtained even after reproduction of 1,000,000 sheets of copying paper.

The visco-elastic characteristic of the above identified toner was measured by determining the temperature dependency of the toner by the Cone and Plate method using a rheopexy analyzer (RPX-705: produced by Iwamoto Seisakusho), under the conditions of cone angle of 3 degrees, cone radius of 1.5 cm, cone apex angle of 87° and frequency of 0.1 Hz, while setting the distortion rate to "auto", and then determining the storage elastic modulus (G') and loss tangent (tan δ) at 150° C. The type of the carrier of the developing agent and evaluation method are the same as those explained in connection with Example 1.

EXAMPLES 10 TO 14 AND COMPARATIVE EXAMPLE 8 TO 12

Fixing characteristics as shown in Table 2 were obtained when the fixing roller of Example 6 was used in combination with toners having different compositions and different visco-elastic characteristics.

TABLE 2

| | | Toner resin | Toner visco-elasticity (at 150° C.) Storage elastic modulus [G'] (Pa) | Loss tangent [tan δ] | Image gloss (%) | Image intensity (%) | Non-offset band (°C.) | Image state |
|---|---|---|---|---|---|---|---|---|
| Example | 10 | Styrene-acryl type | 1680 | 1.6 | 7.0 | 97 | ∘ 166–230 or more | Stable after reproduction of 1,000,000 or more sheets of copying paper |
| | 11 | Styrene-acryl type | 409 | 2.1 | 8.9 | 97 | ∘ 170–230 or more | Good |
| | 12 | Partly crosslinked polyester | 250 | 2.7 | 8.0 | 96 | ∘ 160–230 or more | Good |
| | 13 | Partly crosslinked polyester | 381 | 1.6 | 7.9 | 100 | ∘ 160–230 or more | Good |
| | 14 | Styrene-acryl type | 8970 | 1.2 | 6.5 | 82 | ∘ 170–230 or more | Good |
| Comparative Example | 8 | Styrene-acryl type | 162 | 3.5 | 9.4 | 98 | X 170–190 | Easy to offset |
| | 9 | Styrene-acryl type | 354 | 4.1 | 16.0 | 96 | Δ 170–210 | High level of gloss |
| | 10 | Styrene-acryl type | 135 | 8.6 | 29.0 | 88 | X 180–190 | High level of gloss and easy to offset |
| | 11 | Styrene-acryl type | 62 | 6.0 | 22.5 | 99 | X Offset | High level of gloss and easy to offset |
| | 12 | Styrene-acryl type | 12500 | 1.1 | 6.0 | 60 | Δ 180–230 | Insufficient fixing intensity |

∘: Wide
Δ: Rather narrow
X: Narrow

From Table 2, it can be seen that fixed images of high quality with low level of gloss can be obtained with widened non-offset band, by using toners having loss tangent of not greater than 3 and storage elastic modulus of not less than 200.

EXAMPLE 15

The surface of the cylindrical core 2 made of aluminum alloy was coated, through the intermediary of an adhesive layer (5 μm thick) of a thermosetting epoxy resin, with a layer of ethylene tetrafluoride resin having a modulus of compressive elasticity of 5,500 kg/cm$^2$ after setting and containing 20 vol. % of titanium oxide having a modulus of compressive elasticity of $1\times10^6$ kg/cm$^2$ of particle size ranging between 10 and 15 μm. The coating of ethylene tetrafluoride was then heat-treated to provide a film of 25 μm thick, whereby a fixing roller (outer diameter of 60 mm) of the type shown in FIG. 1 was obtained with a high degree of surface smoothness.

The fixing roller was incorporated in a fixing device and images fixed by this fixing device were subjected to measurement of gloss of fixed image and fixing intensity conducted in the same way as Example 1. High quality image with a low level of gloss of 8.5% and high degree of fixing intensity of 93% could be obtained.

EXAMPLE 16

Measurement of gloss degree and fixing intensity were measured by the same method as Example 1, except that the titanium oxide of Example 15 was substituted by thermally setting polyimide (a modulus of compressive elasticity: 23,000 kg/cm$^2$) powder having a mean particle size of 13 to 18 μm. High quality image with gloss level of 8.1% and fixing intensity of 94% were obtained.

EXAMPLE 17

The surface of the aforesaid aluminum alloy cylindrical core was coated with a layer of ethylene tetrafluoride resin having a modulus of compressive elasticity of 3,000 kg/cm$^2$ after setting and containing 20 vol. % of titanium oxide having a modulus of compressive elasticity of $1\times10^6$ kg/cm$^2$ of particle size ranging between 22 and 25 μm. A film of 35 μm thick was obtained. Subsequently, heat-contracting tube of PFA (having a modulus of compressive elasticity after setting: 6,700 kg/cm$^2$) was fitted on the coat layer and was heat-treated to provide a film of 25 μm, whereby a fixing roller (outer diameter of 60 mm) of the type shown in FIG. 2 was obtained with a high degree of surface smoothness.

The fixing rolller was incorporated in a fixing device and images fixed by this fixing device were subjected to measurement of gloss of fixed image and fixing intensity conducted in the same way as Example 1. High quality image with a low level of gloss of 8.8% and high degree of fixing intensity of 91% could be obtained.

Examples described hereinbefore are roller-type fixing devices. The invention, however, can be applied to a belt-type fixing device as schematically shown in FIG. 5.

Figure 5:
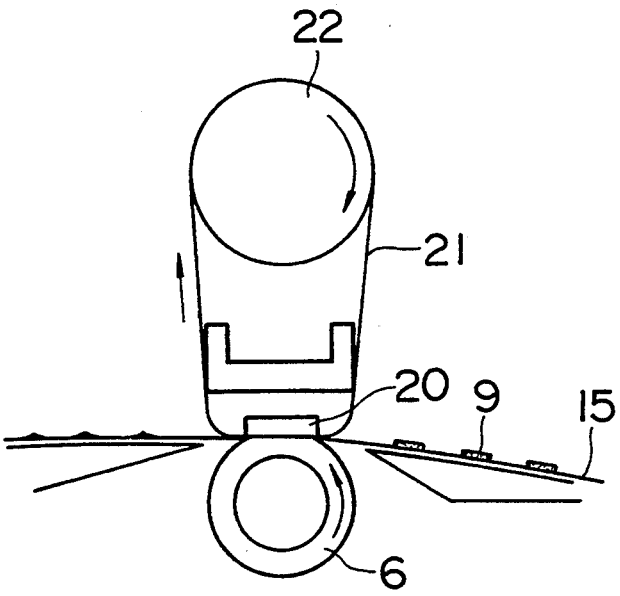
FIG. 5 is a schematic illustration of a different embodiment of the fixing device in accordance with the present invention.

Referring to FIG. 5, a metallic endless belt adapted for contacting with an image supporting member supporting a toner image has a surface layer which may be of anyone of preceding Examples. Thus, the fine irregularities are formed on the image surface on the image supporting member, thus achieving the object of the invention.

In a specific form of the invention, the pressing means, i.e., the fixing roller, which contacts with surfaces of the toner image on the image supporting member has a surface layer composed of a soft matrix and hard granules or particles dispersed therein so that fine irregularities are formed on the fixed image surface so as to scatter light. It is thus possible to obtain a monochromatic fixed image of a high quality.

The fixing roller may have a surface layer having a smaller modulus of compressive elasticity than that of the above-mentioned granules or particles so that fine irregularities appear on the surface of the surface layer under application of the fixing pressure. This fixing device suppresses gloss of the image after fixing, thus providing monochromatic fixed image of high quality.

A similar effect can be obtained by using a fixing roller having an underlying layer of a greater modulus of compressive elasticity than that of the surface layer or an underlying layer having a surface provided with fine irregularities. In this type of fixing device, the fine irregularities can be stably formed on the fixed image surface until the surface layer is completely worn down.

The fixing device of the invention, when used in heat-fixing process, offers an advantage in that the thickness of the surface layer can be reduced to improve transfer of heat, thus ensuring a greater fixing intensity of the fixed image.

The fixing roller of the present invention can operate over a long period of time, stably providing fixed images of high quality and high degree of fixing intensity substantially the same as initial quality and fixing intensity, even after production of consecutive 1,000,000 or more sheets of copying paper. Thus, the fixing device of the invention can withstand a long use without requiring any maintenance work.

What is claimed is:

1. An electrophotographic apparatus comprising a photosensitive drum having a photoconductive layer on the surface thereof;

charging means for giving the surface of said photosensitive drum predetermined electric charges;

light irradiating means for irradiating light to said surface of said photosensitive drum in accordance with image information so that charges are locally removed from said surface of said photosensitive drum thereby forming an electrostatic latent image;

developing means for developing said electrostatic latent image into a visible toner image by a toner;

transfer means for transferring said toner image to an image supporting member;

fixing means for fixing the transferred toner image onto said image supporting member;

charge removing means for removing residual electric charges remaining on said photosensitive drum after the transfer; and cleaning means for removing any residual toner from the surface of said photosensitive member after the transfer;

wherein said fixing means comprising a fixing roller and a pressing roller which are adapted to rotate while contacting each other, said fixing roller including a cylindrical core and a surface layer of a uniform film thickness on said cylindrical core, the surface of said core having a greater modulus of compressive elasticity than that of said surface layer so that, under application of fixing pressure, said surface layer is deformed so as to form fine irregularities on toner surfaces on said image supporting member, and wherein said fixing roller further includes an underlying layer of a resin formed on said cylindrical core between said core and surface layer, and wherein said surface layer is formed of a resin on said underlying layer, said underlying layer having a larger elastic modulus than that of said surface layer and a surface of 5 to 50 μm in terms of a ten point average roughness or said underlying layer formed of a resin containing fillers uniformly dispersed therein, which fillers have a mean particle size of 5 to 50 μm and a larger elastic modulus than that of said surface layer or said underlying layer.

2. A fixing device for use in an electrophotographic apparatus including a pair of opposed pressing means forming a nip therebetween through which an image supporting member supporting an unfixed toner image is passed so that the toner image is fixed to said image supporting member, wherein said pressing means is adapted to contact the toner surfaces on said image supporting member and comprises a layer formed of a soft matrix, in which are disposed annular particles having a greater modulus of compressive elasticity by not less than 2000 kg/cm$^2$ than that of said matrix so as to form fine irregularities of 5 to 50 μm in terms of ten-point average roughness on the toner surfaces on said image supporting member under application of pressure during fixing.

3. A fixing device for use in an electrophotographic apparatus including a pair of opposed pressing means forming a nip therebetween through which an image supporting member supporting an unfixed toner image is passed so that the toner image is fixed to said image supporting member, wherein said pressing means is adapted to contact toner surfaces on said image supporting member and comprises an underlying layer formed of a soft matrix having granular particles of a greater hardness than that of said matrix dispersed therein and a surface layer formed on said underlying layer, said granular particles having a greater modulus of compressive elasticity by not less than 2000 kg/cm$^2$ than that of said surface layer so as to deform said surface layer upon application of pressure during fixing of the image to form fine irregularities of 5–50 μm in terms of ten-point average roughness on the toner surfaces on said image supporting member.

4. A fixing device for use in an electrophotographic apparatus including a pair of opposed pressing means forming a nip therebetween through which an image supporting member supporting an unfixed toner image is passed so that the toner image is fixed to said image supporting member, wherein said pressing means is adapted to contact toner surfaces on said image supporting member and comprises an underlying layer and a surface layer formed on said underlying layer, said underlying layer having a greater modulus of compressive elasticity by not less than 2000 kg/cm$^2$ than that of said surface layer so as to deform said surface layer under application pressure during fixing of the image to form fine irregularities of 5–50 μm in terms of ten-point average roughness on the toner surfaces on said image supporting member.

5. A fixing device for use in an electrophotographic apparatus according to one of claims 2, 3 or 4, wherein at least one of said pair of opposed pressing means comprises a roller.

6. A fixing device for use in an electrophotographic apparatus including a pair of opposed pressing means forming a nip therebetween through which an image supporting member supporting an unfixed toner image is passed so that the toner image is fixed to said image supporting member, wherein said pressing means includes rollers, one of which is adapted to contact toner surfaces on said image supporting member and comprises a metal cylindrical core and a surface layer of resin formed on said core having particles dispersed therein such that when said surface layer is deformed under application of pressure during fixing irregularities are caused to appear on the surface of the surface layer to form fine irregularities of 5–50 μm in terms of ten-point average roughness on the toner surfaces on said image supporting member.

7. A fixing device for use in an electrophotographic apparatus including a pair of opposed pressing means forming a nip therebetween through which an image supporting member supporting an unfixed toner image is passed so that the toner image is fixed to said image supporting member, wherein said pressing means comprises rollers, one of which is adapted to contact toner surfaces on said image supporting member and comprises a cylindrical core, an underlying layer, and a surface layer of resin, respectively, formed on said core, said underlying layer having a greater modulus of compressive elasticity by not less than 2000 kg/cm$^2$ than that of said surface layer so as to deform said surface layer upon application pressure during fixing to form fine irregularities of 5–50 μm in terms of ten-point average roughness on toner surfaces on said image supporting member.

8. A fixing device for use in an electrophotographic apparatus including a pair of opposed pressing means forming a nip therebetween through which an image supporting member supporting an unfixed toner image is passed so that the toner image is fixed to said image supporting member, wherein said pressing means comprises rollers, one of which is adapted to contact the toner surfaces on said image supporting member and comprises a cylindrical core, an underlying layer, and a surface layer of resin, respectively, formed on said core, said underlying layer having a granular particles of a greater modulus of compressive elasticity by not less than 2000 kg/cm$^2$ than that of said surface layer dispersed therein so as to deform said surface layer upon application pressure during fixing to form fine irregularities of 5–50 μm in terms of ten-point average roughness on the toner surfaces on said image supporting member.

9. A fixing device for use in an electrophotographic apparatus including a pair of opposed pressing means forming a nip therebetween through which an image supporting member supporting an unfixed toner image is passed so that the toner image is fixed to said image supporting member, wherein said pressing means is adapted to contact toner surfaces on said image supporting member and is fashioned as an endless belt having a surface comprising a layer formed of a soft matrix and having granular particles of a greater modulus of compressive elasticity by not less than 2000 kg/cm$^2$ than that of said soft matrix dispersed therein said granular particles being adapted to form fine irregularities of 5–50 μm in terms of ten-point average roughness on the toner surfaces on said image supporting member under application of pressure during fixing.

10. A fixing device for use in an electrophotographic apparatus including a pair of opposed pressing means forming a nip therebetween through which an image supporting member supporting an unfixed toner image is passed so that a toner image is fixed to said image supporting member, wherein said pressing means is adapted to contact toner surfaces on said image supporting member and is fashioned as an endless belt having a surface comprising an underlying layer formed of a soft matrix and having granular particles of a greater modulus of compressive elasticity by not less than 2000 kg/cm$^2$ than that of said soft matrix so as to deform said surface layer under application of pressure during fixing to form fine irregularities of 5–50 μm in terms of ten-point average roughness on toner surfaces on said image supporting member.

11. A fixing device for use in an electrophotographic apparatus including a pair of opposed pressing means forming a nip therebetween through which an image supporting member supporting an unfixed toner image is passed so that the toner image is fixed to said image supporting member, wherein said pressing means is adapted to contact toner surfaces on said image supporting member and is fashioned as an endless belt comprising a surface having an underlying layer and a surface layer formed on said underlying layer, said underlying layer having a greater modulus of compressive elasticity by not less than 2000 kg/cm$^2$ than that of said surface layer so as to deform said surface layer under application of pressure during fixing to form fine irregularities of 5–50 μm in terms of ten-point average roughness on the toner surfaces on said image supporting member.

12. A fixing device for use in an electrophotographic apparatus according to one of claims 2, 3, 4, 6, 7, 8, 9, 10 or 11, wherein at least one of said pair of opposed pressing means comprises a heating means.

13. A fixing device for use in an electrophotographic apparatus according to one of claims 7 or 11, wherein said underlying layer is formed of a fluorine-type polyimide and said surface layer is formed of a fluro resin or a fluoric heat-contracting resin having a smaller modulus of compressive elasticity by not less than 2000 kg/cm$^2$ than that of the fluorine-type polyimide.

14. An electrophotographic apparatus including a photosensitive drum having a photoconductive layer formed on a surface thereof;

charging means for providing predetermined electric charges on a surface of said photosensitive drum;

light irradiating means for irradiating light to said surface of said photosensitive drum corresponding to image information;

developing means for developing an electrostatic latent image on said photosensitive drum, which is formed by locally removing a part of said charges through said light irradiation into a visible toner image by a toner;

transfer means for transferring said toner image to an image supporting member;

fixing means for fixing the toner image transferred to said image supporting member;

charge removing means for removing residual electric charges remaining on the surface of said photosensitive drum after the transfer; and cleaning means for removing any residual toner remaining on the surface of said photosensitive drum after the transfer, wherein said fixing means comprising a fixing roller and a pressing roller which are adapted to rotate while contacting each other, said fixing roller including a cylindrical core and a surface layer of a uniform film thickness on said cylindrical core, a surface of said core having a greater modulus of compressive elasticity by not less than 2,000 kg/cm$^2$ than that of said surface layer so as to deform said surface layer upon application of pressure during fixing to form fine irregularities of 5 to 50 μm in terms of ten-point average roughness on the toner surfaces of said image supporting member.

15. An electrophotographic apparatus according to claim 14, wherein, formed under said surface layer of said fixing roller, is an underlying layer having a greater modulus of compressive elasticity by not less than 2000 kg/cm$^2$ than that of said surface layer, said underlying layer being adapted to deform said surface layer upon application of pressure during fixing to form fine irregularities of 5 to 50 μm in terms of ten-point average roughness on the toner surfaces on said image supporting member.

16. An electrophotographic apparatus according to claim 14, wherein said fixing roller of said fixing means comprises a cylindrical core, an underlying layer of a resin formed on said core and a surface layer of a resin formed on said underlying layer, and wherein said underlying layer is formed of a fluorine-type polyimide, and said surface layer is formed of a fluro resin or a fluoric heat-contracting resin which has a smaller modulus of compressive elasticity by not less than 2000 kg/cm$^2$ than that of the fluorine-type polyimide.

17. An electrophotographic apparatus according to claim 14, wherein said fixing roller of said fixing means comprises a cylindrical core, an underlying layer of a resin formed on said cylindrical core and a surface layer of a resin formed on said underlying layer, and wherein said underlying layer is contains fillers having a mean particle size of 5–50 $\mu$m and a greater modulus of compressive elasticity by not less than 2000 kg/cm$^2$ than that of said surface layer, said fillers being uniformly dispersed in said underlying layer so as to form said surface layer upon application of pressure during fixing to form fine irregularities of 5–50 $\mu$m in terms of ten-point average roughness on the toner surfaces on said image supporting member.

18. An electrophotographic apparatus according to claim 14, wherein said toner has a storage elastic modulus of $2\times10^2$ Pa or more and a loss tangent of 4 or less at a temperature of 150° C.

* * * * *